United States Patent [19]

Castellano et al.

[11] Patent Number: 4,537,404

[45] Date of Patent: Aug. 27, 1985

[54] BROADHEAD ARROW HEAD STRUCTURE

[76] Inventors: Gary M. Castellano, 527 Elizabeth Ave., Grand Rapids, Minn. 55744; Kenneth W. Alto, Rte. 2, Bovey, Minn. 55709

[21] Appl. No.: 683,607

[22] Filed: Dec. 19, 1984

[51] Int. Cl.[3] ..... F41B 5/02

[52] U.S. Cl. ..... 273/422; 30/337

[58] Field of Search ..... 273/422; 30/337

[56] References Cited

U.S. PATENT DOCUMENTS

| | | | |
|---|---|---|---|
| 2,940,758 | 6/1960 | Richter | 273/106 |
| 3,756,600 | 9/1973 | Maleski | 273/106 |
| 3,915,455 | 10/1975 | Savora | 273/106 |
| 4,146,226 | 3/1979 | Sorensen | 273/422 |
| 4,169,597 | 10/1979 | Maleski | 273/106 |
| 4,410,184 | 10/1983 | Anderson | 273/422 |

*Primary Examiner*—Paul E. Shapiro

*Attorney, Agent, or Firm*—Leo Gregory

[57] ABSTRACT

A broadhead arrow head structure armed with razor type blades spaced thereabout, each of the blades being positioned into a slot, each blade having an underlying forwardly projecting tongue portion, the tongue portions extending into an undercut recess of the slots, and the arrow head structure being threaded into an arrow shaft to lock the blades in operating position.

7 Claims, 5 Drawing Figures

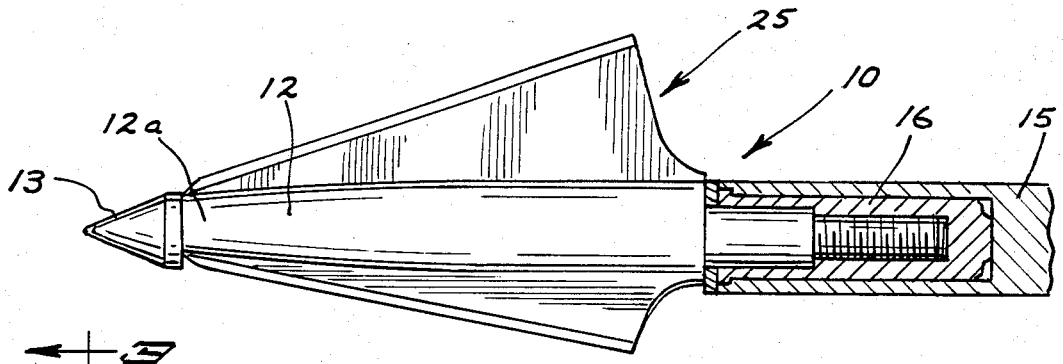
FIG. 1
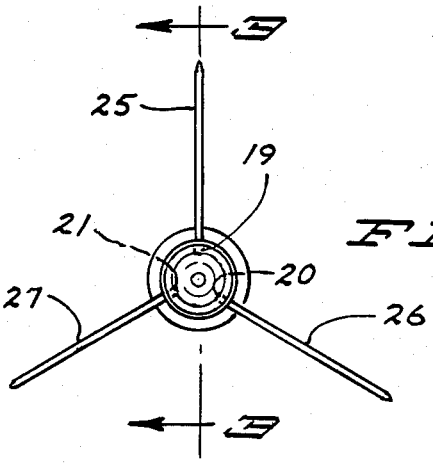
FIG. 2
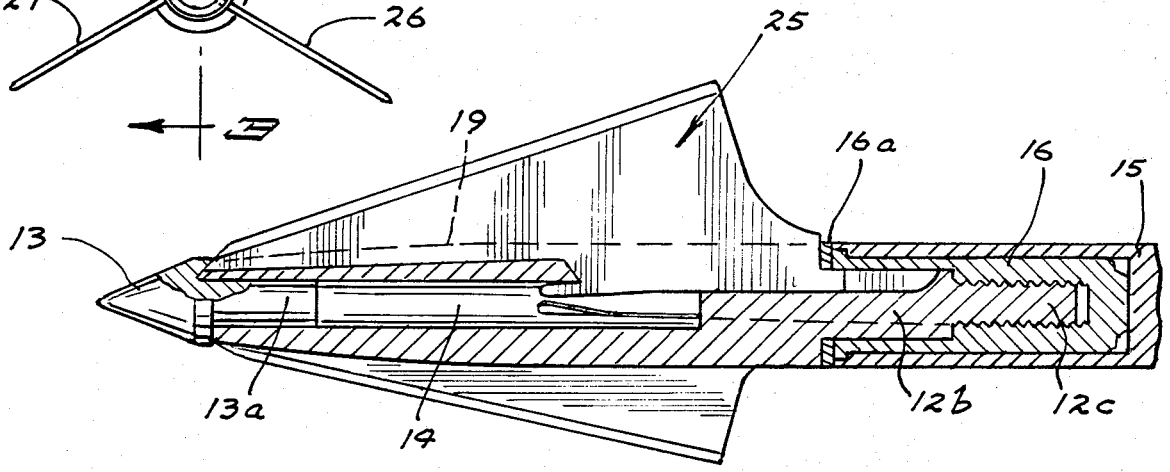
FIG. 3
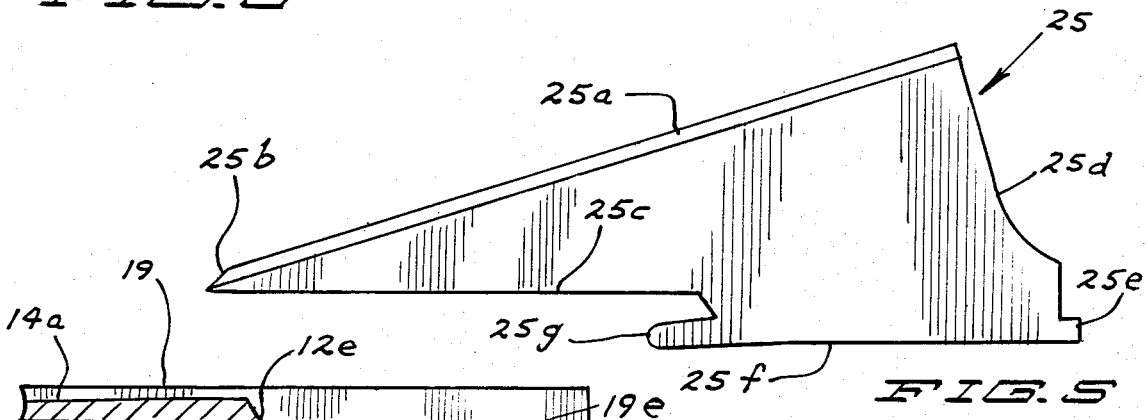
FIG. 5
FIG. 4

BROADHEAD ARROW HEAD STRUCTURE

BACKGROUND OF THE INVENTION

1. Field of the Invention.

This invention relates to broadhead arrow head structure.

2. Description of the Prior Art.

Broadhead arrows are in common use for game hunting. Razor type blades are commonly used to arm the arrow heads.

Various specific structural arrangements are utilized to secure the blades in operating position.

Shown in U.S. Pat. No. 4,146,226 to Sorensen is an assembly comprising an arrow head body having a plurality of blades thereabout disposed in longitudinal slots, the blades having tongues engaging undercut portions of the slots and having a bolt extend through the body of the arrow head to engage a rear retaining member which in turn threads into the arrow shaft.

In U.S. Pat. No. 3,915,455 to Savora, a structure is disclosed in which a locking ring is used to secure the blade inserts.

In U.S. Pat. No. 4,410,184 to Anderson, axial slot segments are disclosed to receive end portions of angled blades.

In U.S. Pat. Nos. 4,169,597 and 3,756,600, both to Maleski, rings are disposed about the arrow head to secure the blades thereon.

In U.S. Pat. No. 2,940,758 to Richter, slots are provided for the blades and front and rear terminal members are threaded into the arrow head to secure the blades.

It is desirable to have a simpler yet more secure structure than appears to be present in the prior art for the purpose of locking blades into operating position about an arrow head.

SUMMARY OF THE INVENTION

It is an object of this invention to provide a broadhead arrow head construction which is a simple structure of relatively few parts to assemble in its manufacture and which is arranged to have the blade members well secured against any displacement.

It is another object of the invention herein to provide a broadhead arrow head of a substantially unitary structure having a body portion having spaced slots thereabout, blade members disposed in said slots, said blade members having depending forwardly projecting tongues, a bore in said body portion to receive said tongues in a locking engagement and an arrow shaft receiving one end portion of said arrow head and securing said blades.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in side elevation with a portion in section;

FIG. 2 is a view in end elevation;

FIG. 3 is a view in vertical section taken on line 3—3 of FIG. 2;

FIG. 4 is a broken view partially in vertical section showing a detail of structures; and FIG. 5 is a view in side elevation of the blade portion of the structure.

DESCRIPTION OF A PREFERRED EMBODIMENT

Referring to the drawings, a broadhead arrow head structure 10 is shown comprising a basic body portion 12 which is substantially cylindrical in form having a somewhat tapered forward portion 12*a* terminating in a sharply pointed tip 13 having an extended body portion 13*a* projecting inwardly into a bore 14 formed into said body portion and being secured therein by a pressure fit.

The rear end portion of said body portion is stepped down in diameter at 12*b* to form a reduced or stepped down body portion and again further at 12*c*. The portion 12*c* is threaded to be received into a tapped receptacle 16 formed as an insert in the adjacent end portion of an arrow shaft 15.

Spaced about said body portion, as here shown, are three longitudinal slots 19, 20 and 21 which, extend as shown in connection with the slot 19, from the forward end of said body portion for the full length thereof. Said slots do not penetrate to said bore at 14 at their forward portions.

As will be noted, the slot 19 at its portion 19*e* is at a depth whereby the forward portion thereof, as at the point 12*e* of said body portion, communicates with said bore 14.

Adapted to be disposed into said slots 19–21 are blade members 25–27 which are not unlike razor blades.

Describing the blade 25 as representative of the others, said blade has a straight cutting edge 25*a* having a tapered point 25*b*. From said point, the blade extends rearwardly as shown at 25*c*. Said blade has a rear end wall 25*d* extending downwardly at an angle to said edge 25*a* and terminates in a projecting tail 25*e* from which said blade extends forwardly as at 25*f* which in operating position is disposed into the slot portion 19*e*. Said portion 25*f* has an elongated forwardly extending hook or tongue portion 25*g* which extends into the bore 14 as illustrated and engages the wall surface thereof under the adjacent overhead portion of said slot 19 whereby said blade is secured by this locking engagement.

The rear end or hump portion 25*e* of said blade is engaged by and locked into position by the adjacent shoulder 16*a* of the receptacle 16 as said threaded portion 12*c* of said arrow head is secured into said receptacle.

The assembly of the above arrow head structure is believed to be clear from the description given. In practice, it has been found that the blades are securely locked into operating position and in testing have shown no indication of displacement.

It will of course be understood that various changes may be made in form, details, arrangement and proportions of the parts without departing from the scope of the invention herein, which generally stated, consists in an arrow head structure capable of the combinations of parts disclosed and defined in the appended claims.

What is claimed is:

1. A broadhead arrow head assembly for attachment to an arrow shaft, having in combination a substantially cylindrical body portion having a tip portion, a bore extending inwardly of said body portion from said tip portion, a plurality of longitudinal slots spaced about said body portion, rearward portions of said slots extending deep enough into said body portion to communicate with said bore, a further rearward extension of said body portion having a threaded end portion, a shaft having means in one end thereof to receive said threaded end portion, blade members disposed into said slots, said blade members respectively having elongated forwardly extending tongue portions, said tongue portions entering said bore and underlying the adjacent body portion to be secured therein, and a shaft having means in one end thereof receiving said threaded end portion and engaging and locking said blade members in operating position.

2. A broadhead arrow head assembly for attachment to an arrow shaft, having in combination a substantially cylindrical body portion, a bore extending into said body portion from the forward end thereof, a plurality of slots spaced about said body portion longitudinally thereof, the rearward portions of said slots being deeper than the forward portions thereof, said rearward portions of said slots communicating with said bore, blade members disposed into said slots, said blade members having elongated forwardly projecting tongue portions which enter said bore, a threaded rear end portion of said body portion, an arrow shaft, means embedded in the forward end of said shaft receiving said threaded end portion, and said blades being engaged by said means and locked into operating position.

3. The structure of claim 2, wherein said body portion has a rearward portion reduced in diameter, whereby said slots in said reduced body portion communicate with said bore.

4. The structure of claim 2, wherein said blade members extend rearwardly to said threaded portion, a tapped receptacle being embedded into said forward end portion of said shaft, and said receptacle engaging said rear end portions of said blades.

5. The structure of claim 4, including a projection tail portion of said blade being engaged by said receptacle.

6. The structure of claim 2, wherein said threaded portion of said body portion being reduced to a size to be received into said shaft.

7. The structure of claim 2, wherein said tongue portions each have such a length that upon insertion into said bore, they underlie and engage the adjacent wall of said bore for a locking engagement which prevents the forward end portions of said blades from being raised out of said slots.

* * * * *

UNITED STATES PATENT AND TRADEMARK OFFICE

CERTIFICATE OF CORRECTION

PATENT NO. : 4,537,404

DATED : August 27, 1985

INVENTOR(S) : Gary M. Castellano and Kenneth W. Alto

It is certified that error appears in the above-identified patent and that said Letters Patent is hereby corrected as shown below:

In claim 1, lines 14 and 15, delete "a shaft having means in one end thereof to receive said threaded end portion,".

Signed and Sealed this

*Seventh* Day of *January 1986*

[SEAL]

*Attest:*

DONALD J. QUIGG

*Attesting Officer*

*Commissioner of Patents and Trademarks*